US008998165B2

(12) United States Patent
Wheeler et al.

(10) Patent No.: US 8,998,165 B2
(45) Date of Patent: Apr. 7, 2015

(54) REINFORCED PLASTIC LOCKING DOGS

(75) Inventors: Ryan A. Wheeler, Waco, TX (US); Julio Palma, Waco, TX (US)

(73) Assignee: Marathonnorco Aerospace, Inc., Waco, TX (US)

( * ) Notice: Subject to any disclaimer, the term of this patent is extended or adjusted under 35 U.S.C. 154(b) by 78 days.

(21) Appl. No.: 13/314,982

(22) Filed: Dec. 8, 2011

(65) Prior Publication Data

US 2013/0146736 A1 Jun. 13, 2013

(51) Int. Cl.
*A47G 29/00* (2006.01)
*E05C 17/30* (2006.01)

(52) U.S. Cl.
CPC ..... *E05C 17/30* (2013.01)

(58) Field of Classification Search
CPC ..... E05C 17/30; E05C 17/20; A47C 3/26; E05Y 2900/502; F16B 7/1409; F16B 7/149
USPC ..... 248/688, 407, 408, 409, 410, 423, 351, 248/354.1; 16/82, 84; 292/305, 306
See application file for complete search history.

(56) References Cited

U.S. PATENT DOCUMENTS

| | | | | | |
|---|---|---|---|---|---|
| 614,192 | A * | 11/1898 | Welles | 248/407 |
| 2,437,940 | A * | 3/1948 | Cramer et al. | 297/298 |
| 2,671,355 | A * | 3/1954 | Hawkins | 74/532 |
| 2,903,226 | A * | 9/1959 | Haveloose | 248/354.5 |
| 3,390,855 | A * | 7/1968 | Solin | 248/188.5 |
| 3,670,821 | A * | 6/1972 | Tamplen | 166/385 |
| 4,753,409 | A * | 6/1988 | Wilcox | 248/409 |
| 5,024,303 | A * | 6/1991 | Kosloff | 188/300 |
| 5,538,299 | A * | 7/1996 | Nemeckay | 292/305 |
| 5,568,954 | A * | 10/1996 | Burgess | 292/338 |
| 5,593,239 | A * | 1/1997 | Sallee | 403/109.3 |
| 5,727,286 | A * | 3/1998 | Shen | 16/49 |
| 6,334,730 | B1 * | 1/2002 | Porte | 403/104 |
| 6,964,411 | B2 * | 11/2005 | Pooschen | 267/64.11 |
| 7,143,473 | B2 * | 12/2006 | Matsuki | 16/86 C |
| 7,198,236 | B2 * | 4/2007 | Warner | 248/125.8 |
| 7,657,970 | B2 * | 2/2010 | Artsiely | 16/85 |
| 7,980,519 | B2 * | 7/2011 | Chen | 248/125.8 |
| 2003/0222191 | A1 * | 12/2003 | Tsai | 248/354.1 |
| 2008/0315058 | A1 * | 12/2008 | Zarpellon | 248/410 |
| 2010/0024161 | A1 * | 2/2010 | Wood et al. | 16/82 |
| 2010/0307872 | A1 * | 12/2010 | Wheeler et al. | 188/67 |
| 2013/0175419 | A1 * | 7/2013 | Wheeler et al. | 248/354.1 |

* cited by examiner

*Primary Examiner* — Bradley Duckworth
(74) *Attorney, Agent, or Firm* — Baker & Hostetler LLP

(57) ABSTRACT

A hold open rod may include: an outer tube and an inner tube; a locking mechanism configured to selectively lock the inner tube with the outer tube; a locking groove in an outer surface of the inner tube; a locking dog and an outer housing covering the locking dog and at least part of the locking mechanism, the outer housing defining a cavity to contain the locking dog when the locking dog is in the outer radial position and also having an angled inner wall configured to engage the locking dog to move the locking dog to the inner radial position when the outer housing is moved to a locking position. A method of actuating a locking rod may be provided.

17 Claims, 6 Drawing Sheets

REINFORCED PLASTIC LOCKING DOGS

FIELD OF THE INVENTION

The present invention relates generally to hold open rods. More particularly, the present invention relates to an apparatus and method for locking a hold open apparatus on a hold open rod.

BACKGROUND OF THE INVENTION

Hold open rods are well known in the both the automotive industry and the aviation industry. Hold open rods hold open a door or hatch after being opened manually or automatically. Hold open rods may support a considerable amount of weight, particularly in the aviation industry. It is desired that the rods function correctly and do not malfunction in supporting the doors or hatches.

Generally hold open rods include two cylindrical telescoping tubes, a first tube disposed inside a second, tube. In the resting position, the inner tube is generally located almost entirely within the outer tube. The inner tube can be extended to a designated position to hold open a door. At the extended position, the tubes are locked in place, holding open the door. Such locking prevents the inner tube from retracting into the outer tube and also subjects the tubes to the weight of the door. The locking mechanism can be released by an operator.

The locking mechanism holding the rods in the extended position can deteriorate or wear over time. Further, some prior art designs may appear to be worn from normal use. It is desirable to provide an improved locking mechanism that functions over long periods of time, holds larger loads reduces the appearance of wear and is durable.

SUMMARY OF THE INVENTION

The foregoing needs are met, to a great extent, by the present invention, wherein in one aspect an apparatus is provided that in some embodiments provides a locking mechanism for hold open rods that functions over long periods of time, holds large loads reduces the appearance of wear and is durable.

In accordance with one embodiment of the present invention, a lockable hold open rod may be provided. The hold open rod may include: an outer tube and an inner tube, the inner tube configured to slide in and out of the outer tube; a locking mechanism configured to selectively lock the inner tube with the outer tube; a locking groove in an outer surface of the inner tube; a locking dog configured to slide along the outer surface of the inner tube when the locking dog is in an outer radial position and fit in the locking groove when the locking dog in an inner radial position; and an outer housing covering the locking dog and at least part of the locking mechanism, the outer housing defining a cavity to contain the locking dog when the locking dog is in the outer radial position and also having an angled inner wall configured to engage the locking dog to move the locking dog to the inner radial position when the outer housing is moved to a locking position.

In accordance with another embodiment of the present invention, a method of actuating a locking rod may be provided. The method may include: moving a lock collar axially along an outer tube; sliding an inner tube with respect to an outer tube to align a locking groove with a locking dog; and moving the locking dog radially inward into the locking groove by sliding a surface on the lock collar against a surface on the locking dog wherein the locking dog is a reinforced plastic material.

In accordance with yet another embodiment of the present invention, a lockable hold open rod may be provided. The hold open rod may include: an outer tube and an inner tube, the inner tube configured to slide in and out of the outer tube; a locking mechanism configured to selectively lock the inner tube with the outer tube; a locking groove in an outer surface of the inner tube; a means for radially engaging configured to slide along the outer surface of the inner tube when the means for radially engaging is in an outer radial position and fit in the locking groove when the means for radially engaging is in an inner radial position; and an outer housing covering the means for radially engaging and at least part of the locking mechanism, the outer housing defining a cavity to contain the means for radially engaging when the means for radially engaging is in the outer radial position and also having an angled inner wall configured to engage the means for radically engaging to move the means for radially engaging to the inner radial position when the outer housing is moved to a locking position.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
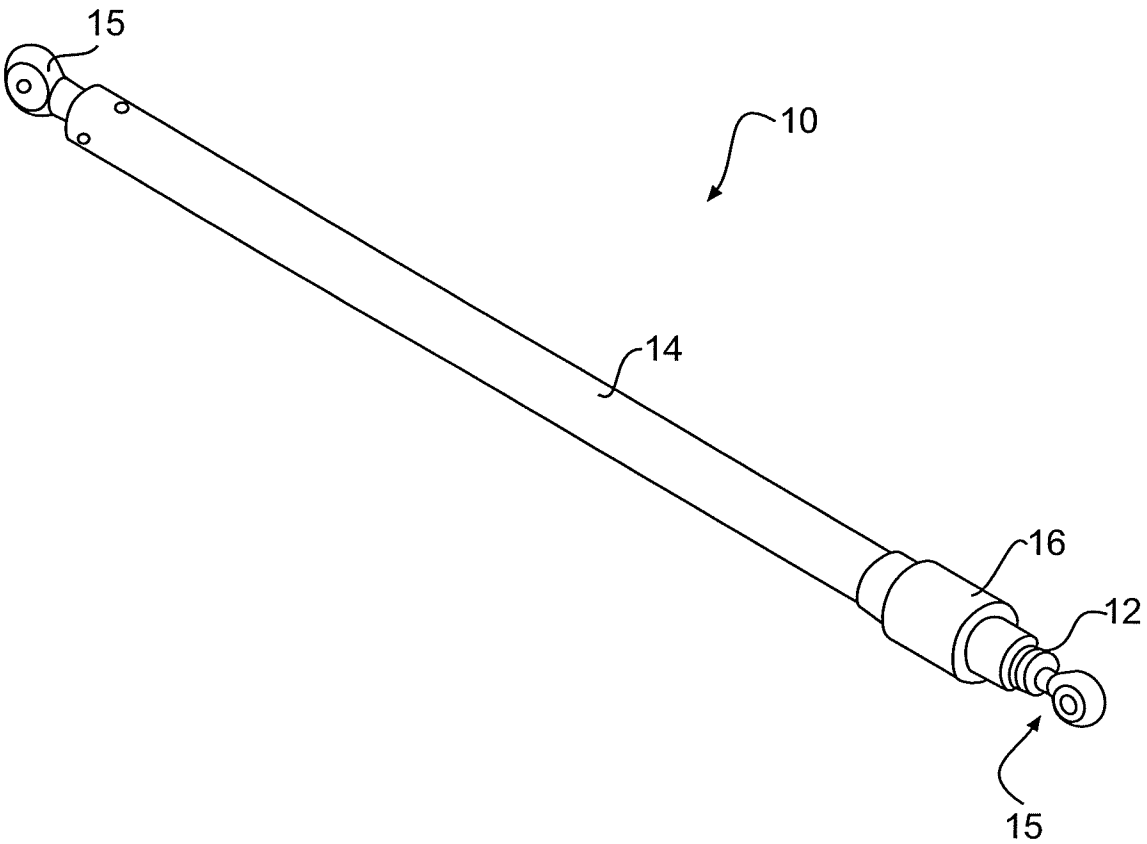
FIG. 1 is a perspective view of a hold open rod system in a retracted position.

The invention will now be described with reference to the drawing figures, in which like reference numerals refer to like parts throughout. An embodiment in accordance with the present invention provides an apparatus is provided that in some embodiments provides a locking mechanism for hold open rods that functions over long periods of time, holds large loads and is durable.

An embodiment of the present inventive apparatus is illustrated in FIG. 1. FIG. 1 is a perspective view of a hold open rod system 10. The hold open rod system 10 includes an inner 12 and outer 14 tube and a locking mechanism 16. Fasteners 15, are connected to the inner 12 and outer 14 tubes. In this view, the system 10 is shown in a retracted, resting position.

Figure 2:
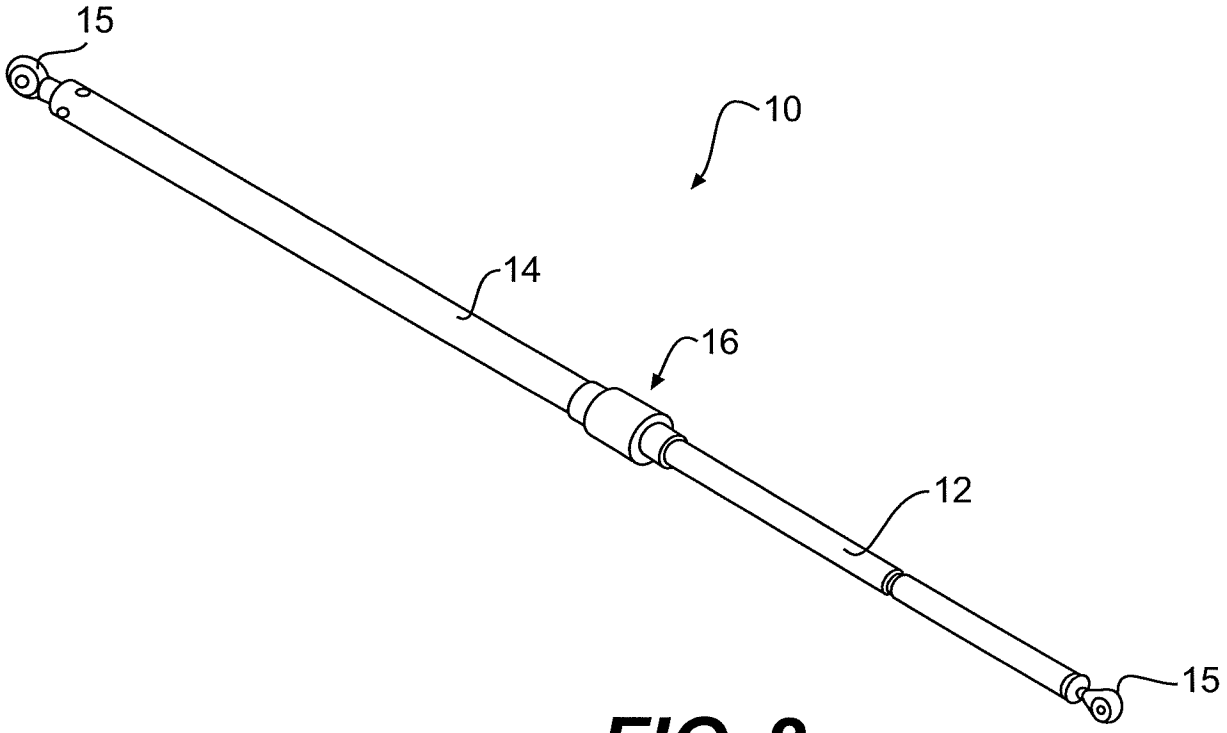
FIG. 2 is a perspective view of the hold open rod system of FIG. 1 in an extended position.

FIG. 2 is a perspective view of the hold open rod system 10 of FIG. 1. In this view, an inner tube 12 is shown extending out from an outer tube 14. Fasteners 15 are connected to the inner tube 12 and the outer tube 14. The fasteners 15 permit the hold open rod system 10 to attach doors or hatches of an aircraft which are to be held open. The fasteners 15 may be threaded, press fit or otherwise attached to the inner 12 and outer rods 14. Fasteners 15 are connected to the inner tube 12 and the outer tube 14. A locking mechanism 16 is shown in an a locking state, as will be described herein.

Figure 3:
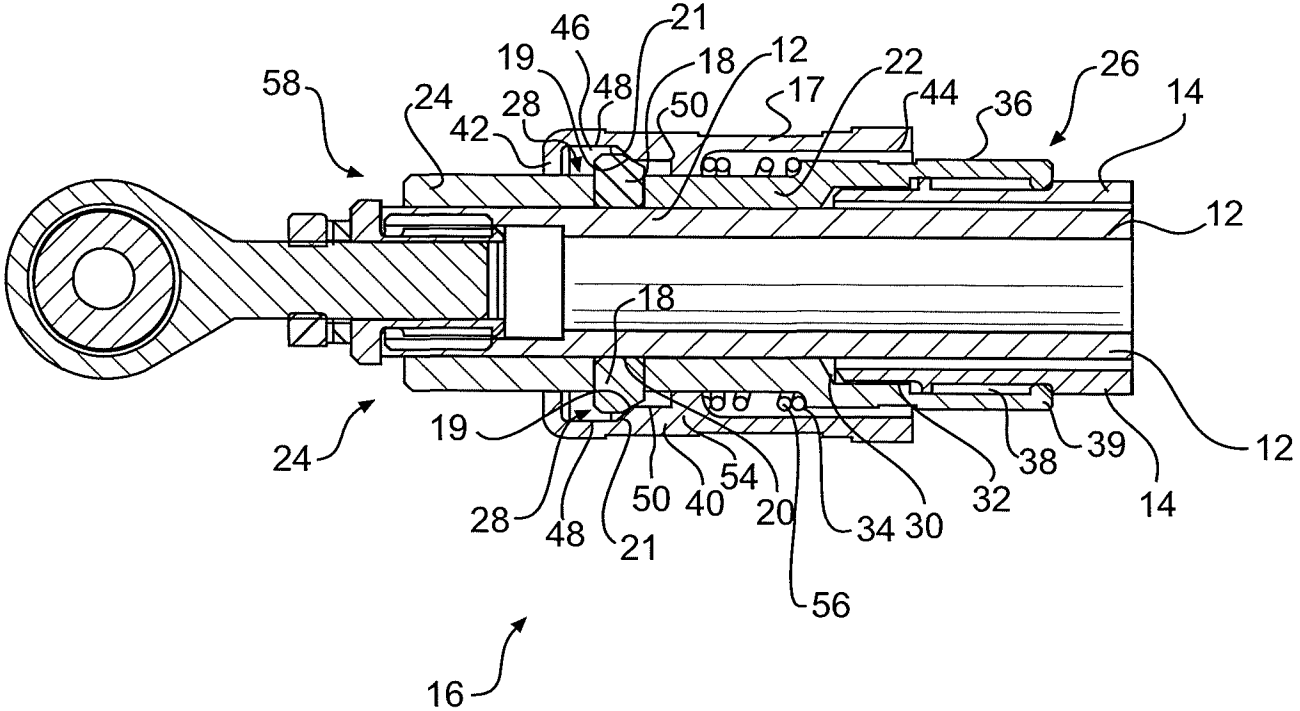
FIG. 3 is a cross-sectional view of a locking mechanism of the hold open rod system of FIG. 1 in the retracted position.

FIG. 3 is a cross-sectional view of the locking mechanism 16 in a retracted, unlocked position. In this position, the inner tube 12 is disposed circumferentially within an outer tube 14. The locking mechanism 16 includes a release collar 40 having an outer housing 17, and locking dogs 18 disposed around the inner tube 12. The dogs 18 may be disposed circumferentially around the inner tube 12 contacting an outside wall 20 of the inner tube 12. As in the embodiment shown there may be two locking dogs 18 that are located opposite to each other. The locking dogs 18 can have a variety of geometries as will be discussed further.

Figure 4:
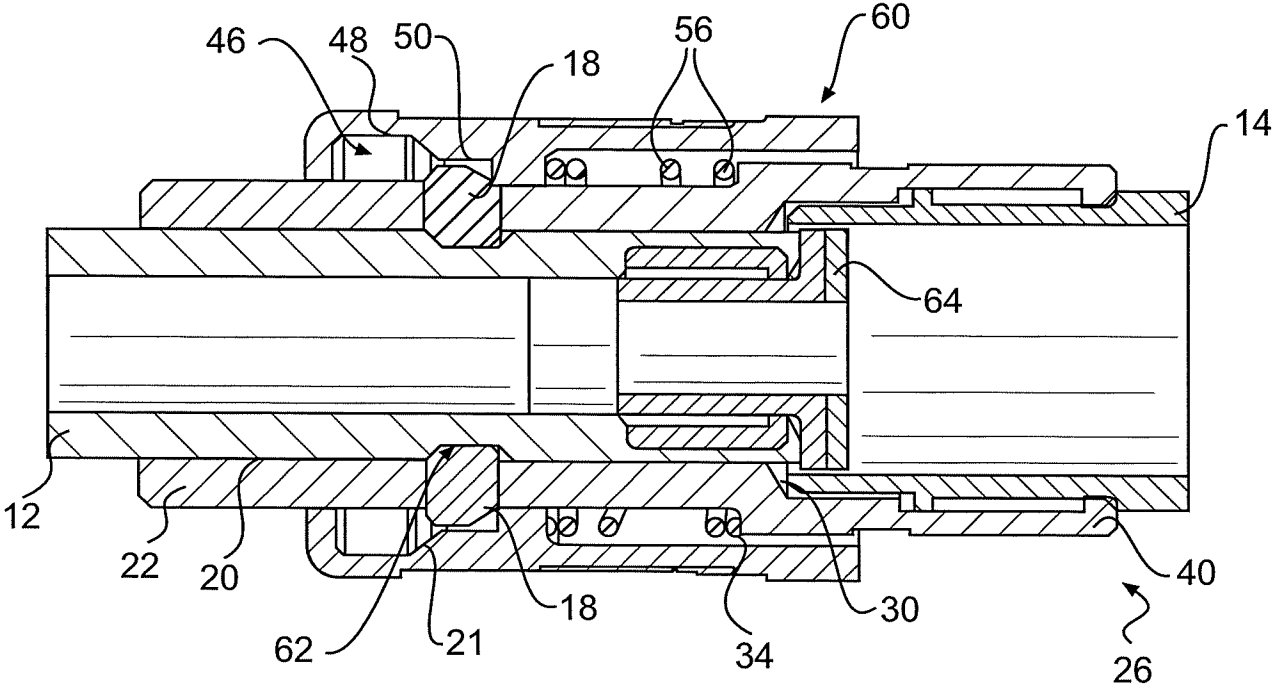
FIG. 4 is a cross-sectional view of the locking mechanism of FIG. 3 in the extended position.

As shown in FIGS. 3 and 4, dogs 18 have a sloped surface 19 in that corresponds with a sloped surface 21 on the outer housing 17. The sloped surface 19 on the dogs 18 and the sloped surface 21 on the outer housing 17 interact to compress the locking dogs 18 which will be discussed further later below.

A lock body 22 surrounds the inner and outer tubes 12, 14 respectively. Specifically, the lock body 22 is a tubular structure that has a first end 24 and a second end 26. The first end 24 and second end 26 have varying diameters, such that the second end 26 has a larger diameter than the first end 24. In some embodiments the second end 26 may have internal threads that permit the inner tube 12 to threadably attach to the release collar 40.

Proceeding longitudinally from the first end 24 to the second end 26, the locking body 22 has a tubular shape. There is at least one larger diameter opening 28 for placement of the locking dogs in the lock body 22. In the cross-sectional illustration depicted in FIG. 3, there are least two such openings 28. Thereafter, the lock body 22 geometry flares outwardly towards the second end 26. This flare is characterized by inner seat 30 formed on an inside surface 32 of the lock body 22 and an outer seat 34 formed on an outer surface 36 of the lock body 22.

Proceeding further toward the second end 26, the lock body has a depression 38 and a lip 39 defined by the depression 38 and the second end 26 for connecting with the outer tube 14. In some embodiments the connection may be via threads. The geometry of the lock body 22 may have a smaller diameter adjacent the first end 24 to accommodate the diameter of just the inner tube that it retains at the first end 24 and a larger diameter adjacent the second end 26 to accommodate the diameters of both the inner tube 12 and the outer tube 14 that it retains at the second end 26.

The lock body 22 and the locking dogs 18 are themselves circumferentially contained within a release collar 40. The release collar 40 generally tubular in shape, has a first end 42 and a second end 44 remote therefrom. Adjacent the first end 42 of the release collar 40 is a release collar cavity 46 for providing a space for locking dogs 18 when the locking dogs 18 are not in a locking position. The release collar cavity 46 has a first portion 48 disposed toward the first end 42 and a second portion 50. Further, the cavity 46 includes the sloped surface 21 that allows the locking dogs 18 to be fed into the second portion 50. The first portion 48 has a larger diameter and geometry than the second portion 50, such that the first portion 48 of the cavity 46 can accommodate the size and shape of the locking dogs 18 when the locking system 10 is in a relaxed, unlocked and retracted state. The second portion 50 of the release collar cavity 46 has a smaller diameter so as to capture and retain the locking dogs 18 when the inner and outer tubes, 12, 14, respectively, are placed in an extended, locked position as shown in FIG. 4.

The release collar 40 further includes a lip 54 for preventing the locking dogs 18 from sliding down the outer wall 20 of the inner tube 12. A spring 56 is positioned inside the release collar 40 to surround the lock body 22. In particular, the spring 56 is retained inside the release collar 40 by the outer seat 34 of the locking collar 22. The spring 56 retracts and contracts as the locking mechanism 16 is locked and unlocked.

FIG. 4 is a depiction of the locking mechanism 16 in an extended, locked position. In FIG. 3, a first end 58 of the inner tube 12 was visible and positioned adjacent the locking mechanism 16. However, in FIG. 4, illustrating the extended, locked position, a second end 60 of the inner tube 12 is visible. The second end 60 of the inner tube 12 includes at least one inner tube groove 62 having a geometry to accommodate the locking dogs 18. The inner tube groove 62 is formed on an outer wall 20 of the inner tube 12. The groove 62 is dimensioned such that the locking dogs 18 will fit between the groove 62 and the second portion 50 of the release collar 40. The groove 62 is formed at a location near the second end 60 so that when the locking mechanism 16 is in the extended locked position, the inner and outer tubes 12, 14 respectively, can have the longest length possible.

The second end 60 also includes a circumferential protrusion or stop 64. The stop 64 catches against the inner seat 30 of the locking body 22 and prevents the inner tube 12 from sliding all the way through the lock body 12. The stop 64 may be formed integrally with the inner tube 12 or be formed separately and attached to the second end of the 60 of the inner tube 12.

In operation, during the relaxed, retracted and unlocked position, the locking dogs 18 are circumferentially spaced about the outer wall 20 of the inner tube 12 and are located adjacent the first portion 48 of the release collar 40 as shown in FIG. 3. An example of when the hold open rod system 10 is in this unlocked position is when a door held open by the hold open rod system 10 is in a closed position. To extend and lock the hold open rod system in place, the inner tube 12 is extended out from the outer tube 14. As the inner tube 12 is extended out, the locking dogs 18 ride on the outer wall 20 of the inner tube 12 until they approach the groove 62 of the inner tube 12. Then, the locking dogs 18 are angled radially inward by the angled surface 21 such that the locking dogs 18 fall into the groove 62 and are held in place by the second portion 50 of the release collar 40. The locking dogs 18 stay thusly situated until an operator releases the locking mechanism.

To release the locking dogs 18, an operator slides the release collar 40 and compresses the spring 56 such that the locking dogs 18 are angled upward and outward, radially by the wall 21, allowing the locking dogs 18 to return to the first portion 48 of the release collar cavity 46. The release collar 40 can be configured such that the locking dogs 18 are released with a pull or slide motion or a turn-and-pull (or slide) motion. Then the locking dogs 18 slide on the outer wall 20 of the inner tube 12 as the inner tube 12 is retracted back into the outer tube 14.

Figure 5:
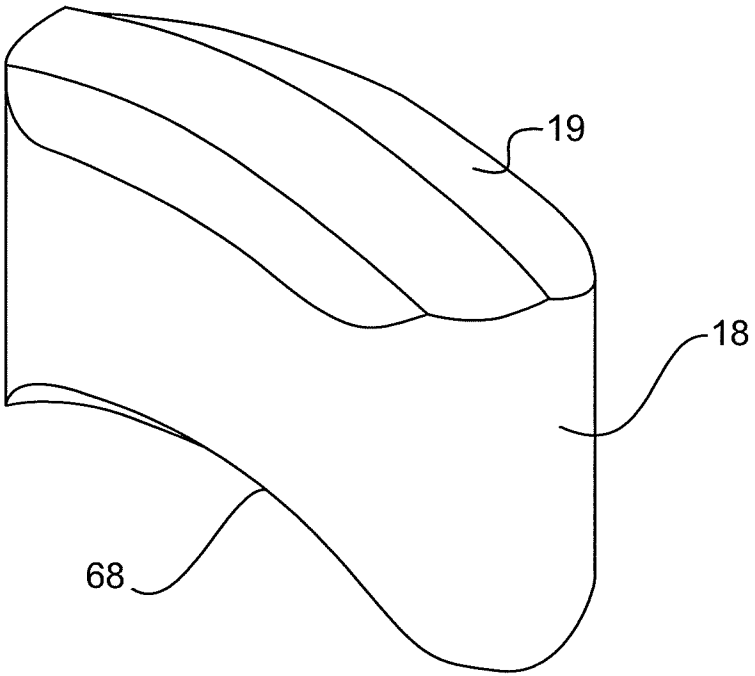
FIG. 5 illustrates another embodiment of a feature of the locking mechanism of FIG. 1.
Figure 7:
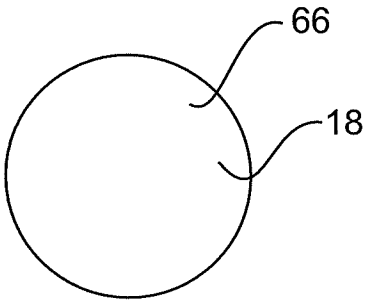
FIG. 7 illustrates still another embodiment of a feature of the locking mechanism of FIG. 1.
Figure 6:
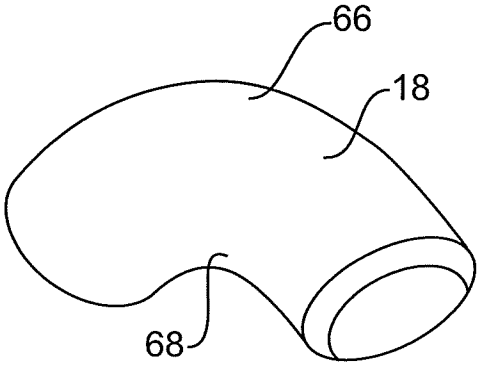
FIG. 6 illustrates yet another embodiment of a feature of the locking mechanism of FIG. 1.

FIGS. 5-7 provide depictions of alternate embodiments of locking dogs 18. In particular, FIG. 5 shows a perspective view of a locking dog 18 having a generally elongated block like structure with rounded ends. FIG. 6 illustrates yet another embodiment of a locking dog 18. This embodiment has a shape similar to a torridal section (a section of a torus) with champhered ends. FIG. 7 illustrates a generally spherical structure. In the embodiments shown in FIG. 5, the locking dog 18 has sloped surface 19 for sliding along the sloped surface 17 on the outer housing 21 as discussed above. The embodiments shown in FIGS. 6 and 7 have general curved surfaces 66. The general curved surfaces 66 perform the function of sliding along the sloped surface 21 of the outer housing 17. The arched sections 68 as shown in FIGS. 5 and 6 allow the dogs 18 to engage the ached groove 62. Thus the locking dogs 18 can have a variety of geometries and are within the scope of the present invention.

Further, in a preferred embodiment of the present invention, the locking dogs 18 are formed of a reinforced plastic material, such as but not limited to, glass or carbon reinforced materials including Polyamide-imide (PAI), such as Torlon™ polymer available from Solvay Plastics. This material is a strong material that can withstand the large loads that the locking mechanism 10 will be subjected to but will not cause wear on the outer wall 20 of the inner tube 12.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

The invention claimed is:

1. A lockable hold open rod comprising:

an outer tube and an inner tube, the inner tube configured to slide in and out of an open end of the outer tube along a longitudinal axis;

a locking mechanism configured to selectively lock the inner tube with the outer tube;

a locking groove in an outer surface of the inner tube;

a locking dog having an inclined surface and a flat surface, the flat surface configured to slide along the outer surface of the inner tube when the locking dog is in an outer radial position and fit in the locking groove when the locking dog is in an inner radial position;

an outer housing covering the locking dog and at least part of the locking mechanism, the outer housing defining a cavity to contain the locking dog when the locking dog is in the outer radial position and also having an angled inner wall configured to engage the inclined surface of the locking dog to move the locking dog to the inner radial position when the outer housing is moved to a locking position; and a spring biasing the outer housing to the locked position, wherein the hold open rod is configured to be attached to access structure of an aircraft; and wherein the outer housing is arranged on the outer tube and extends past the open end of the outer tube along the longitudinal axis.

2. The hold open rod of claim 1, wherein the locking groove is located at a position near an end of the inner tube.

3. The hold open rod of claim 1, further comprising multiple locking dogs.

4. The hold open rod of claim 3, wherein there are two opposing locking dogs.

5. The hold open rod of claim 1, wherein the locking dog is made of a reinforced plastic material.

6. The hold open rod of claim 5, wherein the reinforced plastic material comprises a reinforcing material comprising glass fiber.

7. The hold open rod of claim 5, wherein the reinforced plastic material is a carbon reinforced material comprising Polyamide-imide (PAI).

8. The hold open rod of claim 1, further comprising multiple locking grooves on the inner tube thereby allowing multiple locking positions.

9. The hold open rod of claim 1, wherein the outer housing is actuated to place the locking mechanism in the locking position by twisting the housing and then pushing the outer housing against the force of the spring.

10. A method of actuating a locking rod comprising:

arranging an outer tube and an inner tube, the inner tube configured to slide in and out of an open end of the outer tube along a longitudinal axis;

moving a lock collar axially along the outer tube;

sliding the inner tube with respect to an outer tube to align a locking groove with a locking dog, the locking dog having an inclined surface and a flat surface; and moving the flat surface of the locking dog radially inward into the locking groove by sliding an inclined surface on the lock collar against the inclined surface on the locking dog wherein the locking dog is a reinforced plastic material, wherein the locking rod is configured to be attached to access structure of an aircraft; and wherein the lock collar is arranged on the outer tube and extends past the open end of the outer tube along the longitudinal axis.

11. The method of claim 10, wherein the reinforced plastic material comprises a reinforcing material comprising glass fiber.

12. The method of claim 10, wherein the locking dog is a carbon reinforced material comprising Polyamide-imide (PAI).

13. The method of claim 10, further comprising sliding the locking dog along the inner tube when aligning the locking groove with the locking dog.

14. The method of claim 10, further comprising moving a second locking dog into the locking groove.

15. The method of claim 14, wherein the two locking dogs are oriented in opposition to each other.

16. A lockable hold open rod comprising:

an outer tube and an inner tube, the inner tube configured to slide in and out of an open end of the outer tube along a longitudinal axis;

a locking mechanism configured to selectively lock the inner tube with the outer tube;

a locking groove in an outer surface of the inner tube;

a means for radially engaging the inner tube having an inclined surface and a flat surface, the flat surface configured to slide along the outer surface of the inner tube when the means for radially engaging the inner tube is in an outer radial position and fit in the locking groove when the means for radially engaging the inner tube is in an inner radial position; and an outer housing covering the means for radially engaging the inner tube and at least part of the locking mechanism, the outer housing defining a cavity to contain the means for radially engaging the inner tube when the means for radially engaging the inner tube is in the outer radial position and also having an angled inner wall configured to engage the inclined surface of the means for radically engaging the inner tube to move the means for radially engaging the inner tube to the inner radial position when the outer housing is moved to a locking position, wherein the hold open rod is configured to be attached to access structure of an aircraft; and wherein the outer housing is arranged on the outer tube and extends past the open end of the outer tube along the longitudinal axis.

17. The rod of claim 16, wherein the means for radially engaging is made of a reinforced plastic material.

* * * * *